US005362193A

United States Patent [19]

Milstead

[11] Patent Number: 5,362,193

[45] Date of Patent: Nov. 8, 1994

[54] SELF ERECTING ASPHALT PRODUCTION PLANT

[75] Inventor: John Milstead, Chattanooga, Tenn.

[73] Assignee: Astec Industries, Inc., Chattanooga, Tenn.

[21] Appl. No.: 23,063

[22] Filed: Feb. 25, 1993

[51] Int. Cl.[5] ..... B65G 1/00

[52] U.S. Cl. ..... 414/332; 414/919

[58] Field of Search ..... 414/332, 919; 209/421

[56] References Cited

U.S. PATENT DOCUMENTS 3,458,177 7/1969 Farnham et al. .
3,586,181 6/1971 Brock .
3,909,401 9/1975 Thompson ..... 209/421 X
3,934,739 1/1976 Zumsteg et al. .
4,187,047 2/1980 Squifflet, Sr. ..... 414/332
4,249,351 2/1981 Brock .
4,249,848 2/1981 Griffin et al. ..... 414/332
4,268,208 5/1981 Hankins et al. ..... 414/332
4,337,014 6/1982 Farnham .
4,348,146 9/1982 Brock .
4,387,996 6/1983 Mendenhall .
4,482,281 11/1984 Musil .
4,561,821 12/1985 Dillman .
4,775,275 10/1988 Perry .
4,943,200 7/1990 Edwards et al. .
4,944,646 7/1990 Edwards et al. .
4,993,839 2/1991 Brock .

*Primary Examiner*—David H. Bollinger
*Attorney, Agent, or Firm*—Nilles & Nilles

[57] ABSTRACT

A portable and self-erecting plant for the batch production of asphalt, and wherein the several components of the plant are split into two subassemblies which are initially mounted to the front and rear portions of a roadway transportable main frame. The front subassembly may be lifted to a first temporary position and then moved rearwardly to overlie the rear subassembly. The two subassemblies may then be interconnected to form an operational plant, which may be then lifted to its operating position as a unit. A separate elevator is provided which is also roadway transportable, and the elevator may be pivotally connected to the main frame so that it may be raised to an operative vertical position adjacent the plant.

15 Claims, 4 Drawing Sheets

SELF ERECTING ASPHALT PRODUCTION PLANT

BACKGROUND OF THE INVENTION

The present invention relates to a self erecting apparatus adapted for the batch production of asphalt.

Mobile batch plants for the production of asphalt have heretofore been proposed which generally comprise a truck towed main frame and a complete tower hingedly supported on the main frame so that the tower can be selectively shifted from a lowered transport position to an upright operative position. The tower typically comprises an aggregate screen section at the top of the tower, aggregate storage bins below the screen section, a weigh hopper below the storage bins, and a mixer below the weigh hopper. A mobile plant of this general type is disclosed in U.S. Pat. No. 4,775,275 to Perry.

While the mobile batch plants of the above type are generally satisfactory for batch plants of modest size and weight, their designs are unsuitable for larger plants by reason of the massive weight of the tower which must be pivotally raised and lowered between the transport and operative positions.

It is accordingly an object of the present invention to provide a self erecting batch plant of the described type which may be of significant size and weight, and yet may be readily converted from its lowered transport position to its upright operating position, and then converted back to its lowered position to permit transport to a different job site.

It is another object of the present invention to provide a self erecting batch plant of the described type which may be moved between the transport and upright operating positions without the use of external cranes and the like.

SUMMARY OF THE INVENTION

The above and other objects and advantages of the present invention are achieved in the embodiment illustrated herein by the provision of an apparatus which comprises an elongate main frame having front and rear portions, and a support structure for supporting the main frame upon the ground surface. An asphalt production plant is provided which comprises an upper plant subassembly and a lower plant subassembly, with the upper and lower plant subassemblies collectively comprising, when positioned with the upper plant subassembly immediately above the lower plant subassembly, (a) an aggregate screen section,
(b) a bin section positioned below the screen section and comprising a plurality of side by side bins,
(c) a weigh hopper positioned below the screen section, and
(d) a mixer positioned below the weigh hopper.

The lower plant subassembly is mounted on the rear portion of the main frame and plant lifting means is provided for lifting the lower plant subassembly between a lowered transport position and a raised position.

The upper plant subassembly is mounted for movement between a lowered transport position on the front portion of the main frame and a raised intermediate position immediately above the lower plant subassembly when the lower plant subassembly is in its lowered transport position. The apparatus accordingly may be transported with the upper and lower plant subassemblies positioned in their respective lowered transport positions, and at the job site, the upper plant subassembly may be moved to its raised intermediate position to form the asphalt production plant with the upper and lower plant subassemblies disposed in a vertical arrangement. The plant may then be lifted as a unit to a raised operative position as a unit by the plant lifting means.

In the preferred embodiment, the apparatus further comprises an elongate elevator which defines a material inlet adjacent one end and a material discharge chute adjacent the opposite end. An elevator support frame is releasably mounted to the rear portion of said main frame for pivotally and releasably mounting the elevator for movement between a horizontal transport position and an upright operative position adjacent the lower plant subassembly. Thus when the plant is lifted to its raised operative position and the elevator is raised to its upright operative position, the elevator is adapted to convey aggregate material upwardly from the material inlet to the material discharge chute and into the aggregate screen section.

The elevator support frame defines a horizontal pivot axis spaced rearwardly from the rear portion of the main frame. The material inlet end of the elevator may be pivotally mounted to the support frame so as to pivot about the pivot axis, and pivoting means is provided for pivoting the elevator from its horizontal transport position to its raised operative position, and from the raised position back to its horizontal position. This pivoting means preferably includes a cable which is connected between the medial portion of the length of the elevator and the main frame, and a hydraulic cylinder which is connected between the main frame and the elevator at a location immediately adjacent the outlet end of the elevator.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figures 1, 2:
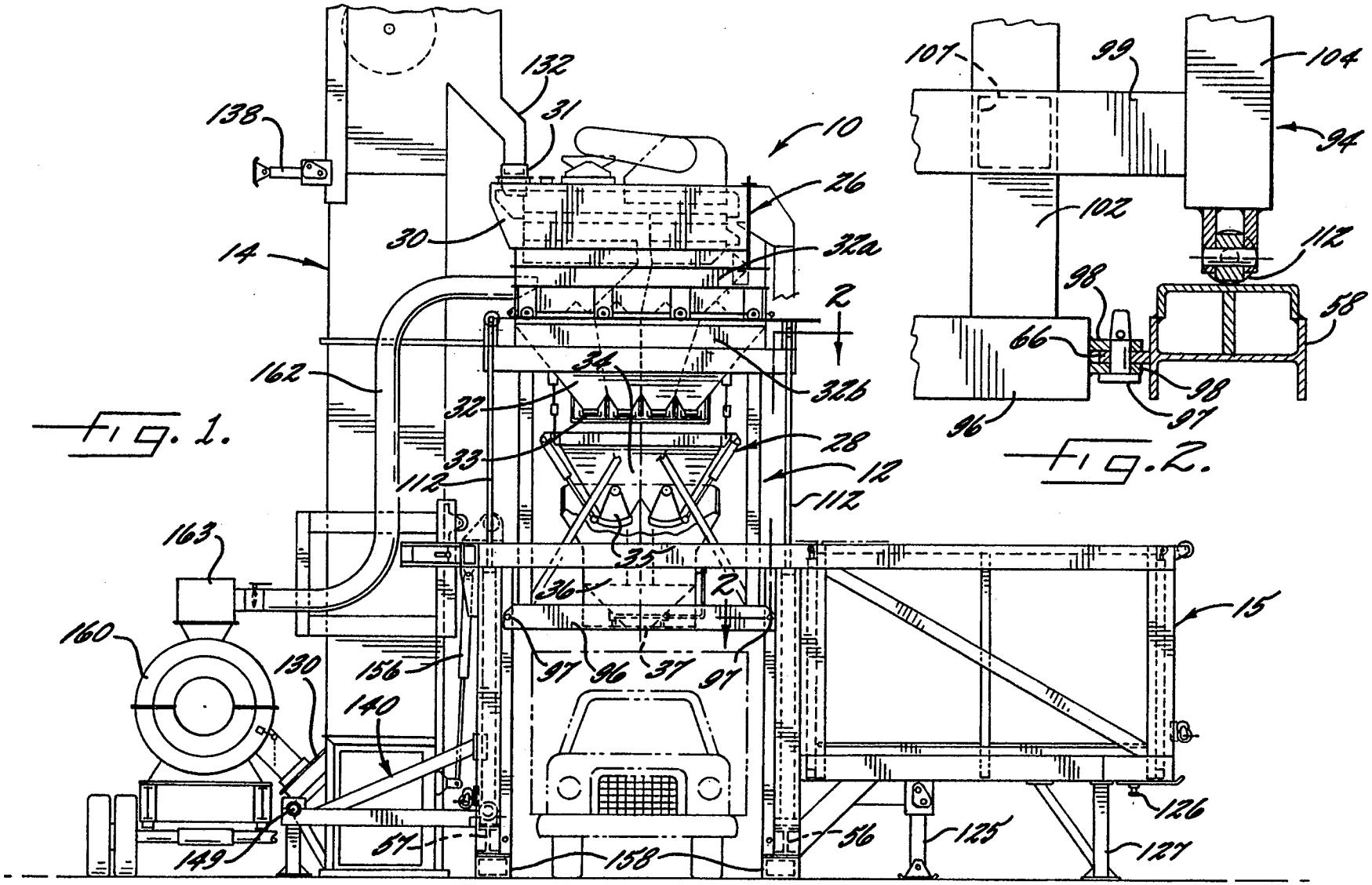
FIG. 1 is a side elevation view of an apparatus which embodies the features of the present invention, shown in its operative position.
FIG. 2 is a fragmentary and enlarged sectional view taken substantially along the line 2—2 of FIG. 1.

Referring more particularly to the drawings, a preferred embodiment of a self erecting asphalt production plant in accordance with the present invention is indicated generally at 10 in FIG. 1. The plant 10 comprises a tower assembly 12 and an elevator 14.

Figures 3, 4, 4A:
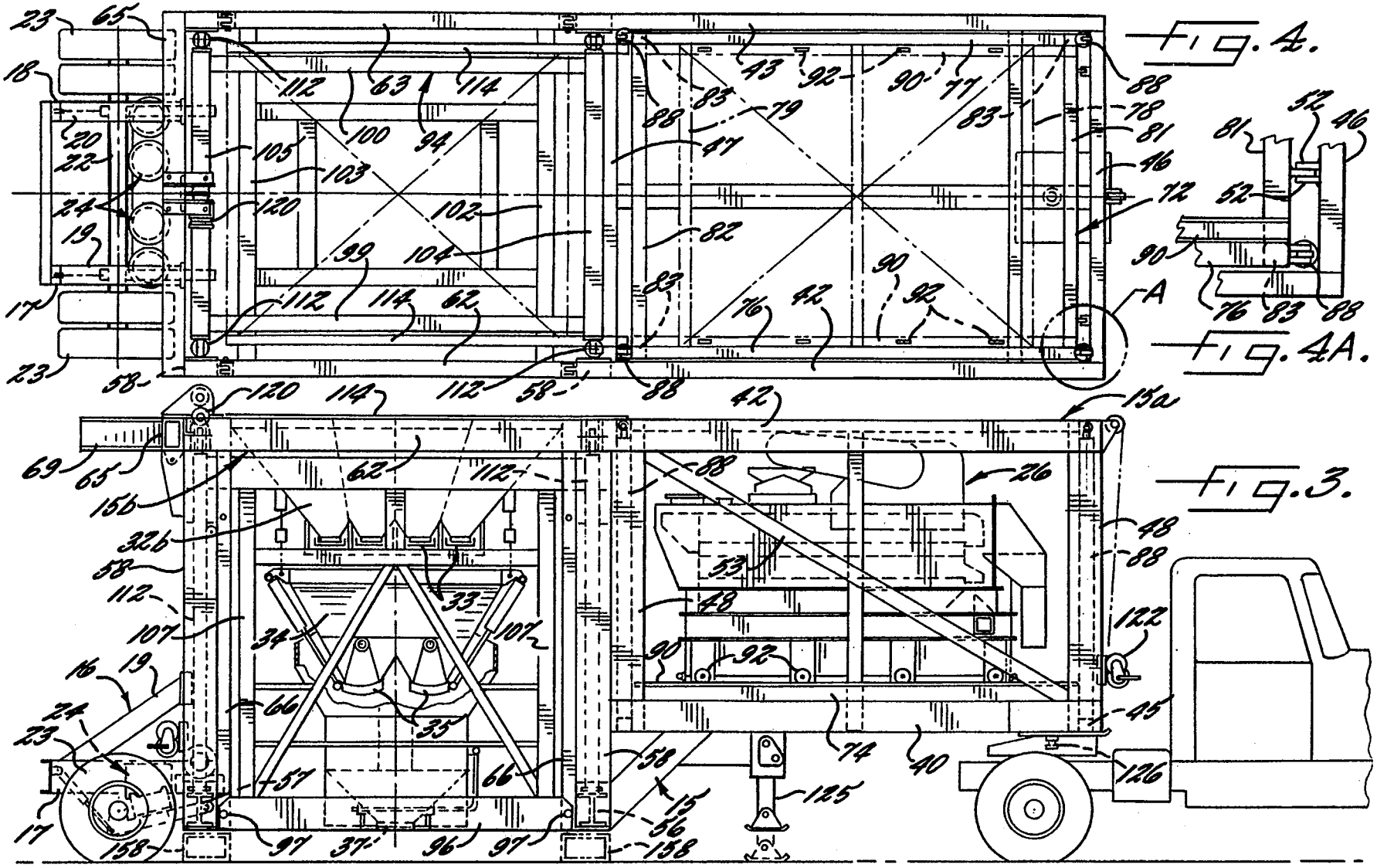
FIG. 3 is a side elevation view of the tower assembly of the apparatus, shown in its transport position.
FIG. 4 is a top plan view of the tower assembly in the configuration of FIG. 3 and with the production plant removed for clarity of illustration.
FIG. 4A is a fragmentary enlarged view of the portion within the circle A of FIG. 4.

The tower assembly 12 of the plant 10 comprises an elongate main frame 15 which is adapted to be transported along a roadway and then lowered into a ground engaging position in the manner further described below. For this purpose, a wheel support carriage 16 is removably mounted to the rear of the frame, and as best seen in FIGS. 3 and 4, the wheel support carriage 16 includes a pair of rearwardly directed horizontal braces 17, 18 with each horizontal brace 17, 18 having one end releasably bolted to the main frame 15 so as to permit its removal for the purposes described below. A pair of inclined braces 19, 20 are also provided, with each inclined brace 19, 20 having one end releasably bolted to the main frame 15 and an opposite end bolted to the free end of an associated horizontal brace 17, 18. The horizontal braces 17, 18 in turn mount an axle 22 which supports the road engaging wheels 23, and the axle 22 is supported by an air bag assembly 24 of the type which permits the wheels 23 to be raised and lowered with respect to the horizontal braces 17, 18 and thus the main frame 15. An air bag assembly of this type is further described in U.S. Pat. No. 4,944,646 to Edwards et al., and the disclosure of this patent is expressly incorporated herein by reference.

The tower assembly 12 of the present invention further comprises an asphalt production plant which is mounted on the main frame. The asphalt production plant is divided into two subassemblies, namely, an upper subassembly 26 and lower subassembly 28.

When the upper and lower subassemblies are interconnected in the vertical operative position as seen in FIG. 1, they collectively form a batch plant which comprises an aggregate sizing screen section 30 mounted at the top of the tower for receiving the aggregate through an inlet 31, and as is conventional, the screen section 30 is adapted to segregate the aggregate by average particle size so as to obtain a plurality of groups of different average particle size. The batch plant 10 further comprises a storage bin section 32 which is composed of a plurality of separate aggregate storage bins which are laterally aligned in a side-by-side relationship below the screen section 30, and such that the segregated groups of aggregate are delivered from the screen section into respective ones of the bins. As illustrated, the bin section 32 is horizontally divided to form a top bin section **32*a* and a bottom bin section 32*b*. Also, a clam shell gate 33** is positioned at the bottom of each bin.

A weigh hopper 34 is positioned below the bin section 32 for weighing out predetermined amounts of the aggregate from each of the aggregate bins. The lower portion of the weigh hopper includes a discharge gate 35 which permits its weighed contents to be discharged into an underlying pugmill 36. The pugmill 36 is preferably of a conventional twin shaft design, and it mixes the weighed out aggregate with a weighed quantity of hot liquid asphalt which is delivered from an asphalt weigh bucket or spray system (not shown). The bottom of the pugmill 36 includes a discharge gate 37 through which the mixed product may be dropped directly into an underlying truck or other receiver.

The components of the batch plant as described above are generally conventional, and a plant having the described components is presently sold by Astec Industries, Inc. of Chattanooga, Tenn. Also, components of the described tower are further illustrated in U.S. Pat. Nos. 4,993,839 and 4,387,996.

In accordance with the preferred embodiment of the present invention, the upper plant subassembly 26 comprises the aggregate screen section 30 and the top bin section **32*a* of the storage bin section 32. The lower plant subassembly 28 includes the remaining components of the plant, namely, the bottom bin section 32*b*, the weigh hopper 34, and the pugmill mixer 36**.

The main frame 15 of the apparatus plant 10 is divided into a front portion **15*a* and a rear portion 15*b*. The front portion 15*a* is in the form of a box-like housing, which is composed of a pair of laterally spaced apart longitudinal bottom braces 40 and a pair of laterally spaced apart longitudinal upper braces 42, 43. A lateral brace 45 interconnects the forward ends of the two bottom braces 40, and lateral braces 46, 47 interconnect the forward and rearward ends of the two upper braces 42, 43, respectively. Also, four vertical corner braces 48 interconnect the aligned ends of the bottom and upper braces. The front lateral brace 46 includes a pair of guide slots 52 as best seen in FIGS. 4 and 4A, for the purposes described below. Also, an inclined brace 53 is mounted on each side of the front portion 15*a*** for added rigidity.

Figures 5, 6, 7:
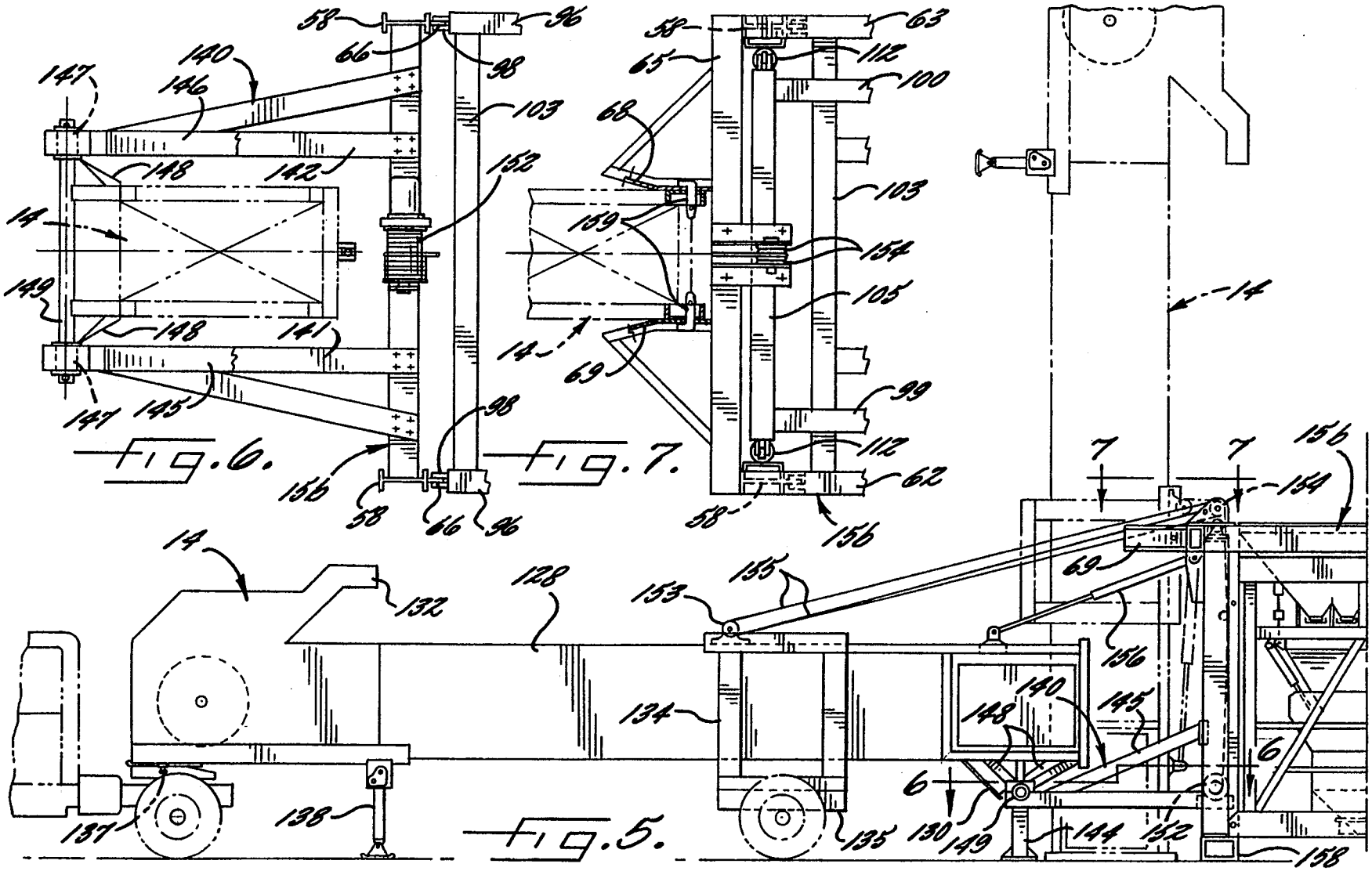
FIG. 5 is a side elevation view of the elevator of the apparatus, shown in its transport position and ready for lifting to its raised upright position.
FIG. 6 is a fragmentary top plan view of the support and pivot assembly for the elevator.
FIG. 7 is a top plan view taken substantially along the line 7—7 of FIG. 5 and illustrating the frame for supporting the elevator in its raised upright position.

The rear portion **15*b* of the main frame 15 is in the form of a housing, which when viewed in side elevation, has the configuration of an inverted U, note FIG. 1. The rear housing portion 15*b* comprises a pair of laterally directed lower braces 56, 57 (FIG. 3). An upright corner brace 58 extends upwardly from each end of each of the lower braces so as to define the four corners of the rear housing portion, and a pair of longitudinal upper braces 62, 63 are fixed between respective pairs of the corner braces and are aligned with and preferably integral with respective ones of the upper braces 42, 43 of the front housing portion 15*a*. A rear lateral brace 65 extends between the rear ends of the longitudinal braces 62, 63. In addition, each corner brace 58 includes a vertical guide rail 66 as further described below, note FIG. 2, and as best seen in FIG. 7, the rear lateral brace 65 mounts a pair of laterally spaced apart and rearwardly extending guide and support arms 68, 69 for receiving the elevator 14** therebetween in the manner described below.

The upper plant subassembly 26 of the apparatus plant 10 is supported within a box-like front framework 72 which is disposed within the front housing portion **15*a* when in its lowered transport position as seen FIG. 3. Also, the front framework 72 and the upper plant subassembly 26 may be selectively moved between the lowered transport position (FIG. 3) and a raised intermediate position as seen in dashed lines in FIG. 8. More particularly, the front framework 72 includes a pair of lower longitudinal braces 74 and a pair of upper longitudinal braces 76, 77. A lateral brace 78 interconnects the forward ends of the two lower braces 74 and another lateral brace 79 interconnects the rearward ends of the two lower braces. Similarly, lateral braces 81, 82 interconnect the forward and rearward ends of the two upper braces 76, 77, respectively. Also, four vertical corner braces 83 interconnect the aligned ends of the lower and upper longitudinal braces 74, 75, 76. A hydraulic cylinder 88 is interconnected between the front housing portion 15***a* and front framework 72 at each of the associated four corners, to effect the vertical movement of the front framework relative to the front housing portion 15*a*.

The front framework 72 includes a pair of longitudinally directed U-shaped rails 90 (FIG. 4A), which extend parallel to and adjacent the two lower longitudinal braces 74. The upper plant subassembly 26 includes bottom rollers 92 along each side thereof which are received in the two rails 90 so as to permit rolling movement of the subassembly along the rails.

Figures 8, 9:
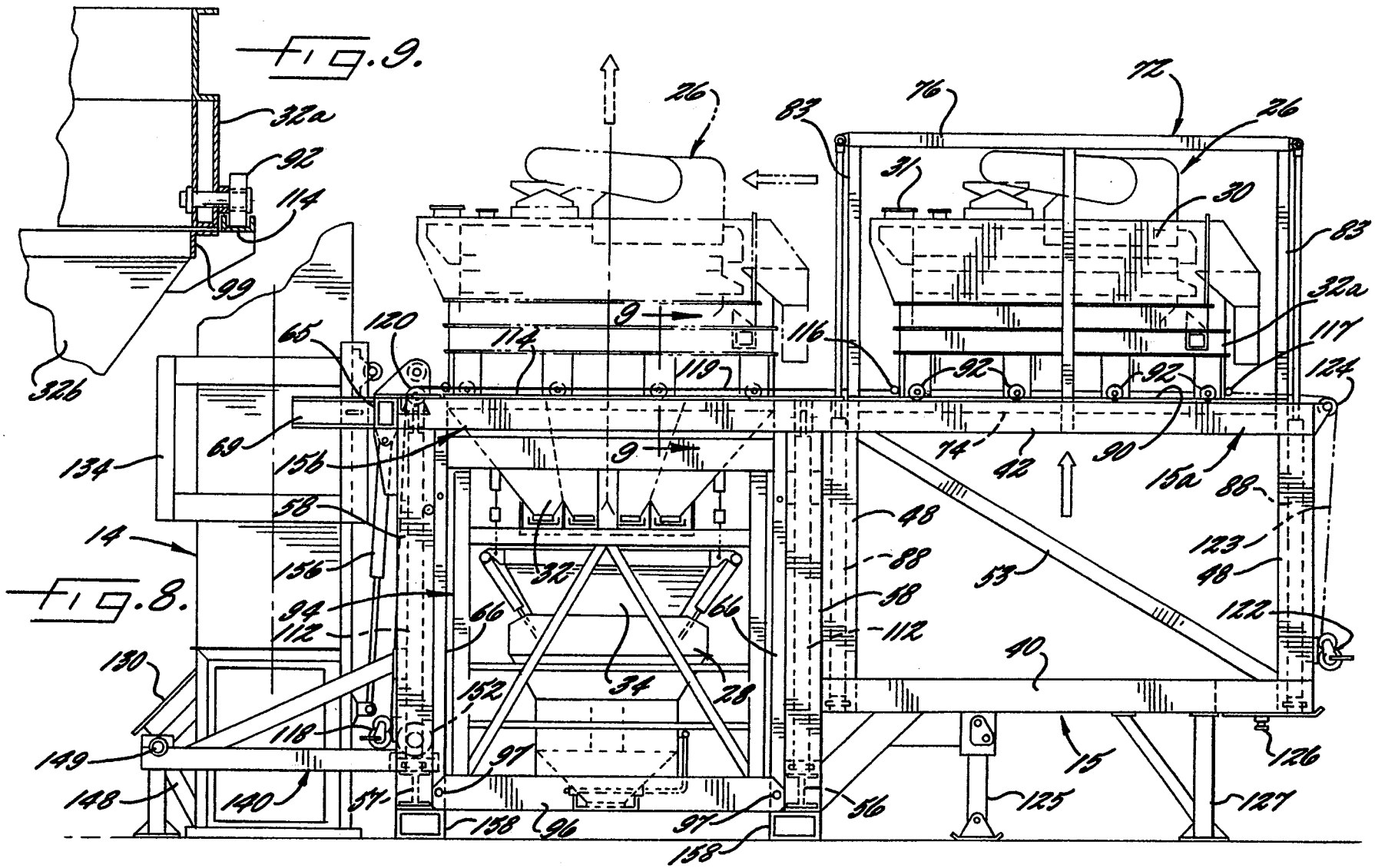
FIG. 8 is a side elevation view of the apparatus with the lower plant subassembly in its lowered position, and illustrating the upper plant subassembly in its lifted temporary position in solid lines and in its raised intermediate position in dashed lines.
FIG. 9 is a fragmentary sectional view taken substantially along the line 9—9 of FIG. 8.

The lower plant subassembly 28 of the apparatus is supported within a box-like rear framework 94, which is disposed within the rear housing portion 15*b*, and the rear framework 94 and the lower plant subassembly 28 may be selectively moved between its lowered transport position as seen in FIG. 8 and a raised position as seen in FIG. 1. The rear framework 94 includes a pair of lower longitudinal braces 96 which lie directly below the braces 62, 63 in plan view (FIG. 4), and the opposite ends of the longitudinal braces 96 each mount spaced brackets 98 which slidably receive the guide rail 66 of the associated corner brace therebetween, note FIG. 2. The brackets 98 are adapted to be pinned to the guide rails 66 of the corner braces 58 by a pin 97 at one of two vertically separated pin locations, compare FIGS. 1 and 8.

The rear framework 94 further includes a pair of upper longitudinal braces 99, 100. A lateral brace 102 interconnects the forward ends of the two lower braces 96, and another lateral brace 103 interconnects the rearward ends of the two lower braces 96. Similarly, lateral braces 104, 105 interconnect the forward and rearward ends of the two upper braces 99, 100 respectively. Also, four vertical corner braces 107 interconnect the aligned end portions of the lower lateral braces 102, 103 and the upper longitudinal braces 99, 100. The rear framework 94 is lifted and lowered by means of four hydraulic cylinders 112 which are connected between the main frame and the ends of the two upper lateral braces 104, 105, note FIGS. 2 and 4.

The rear framework 94 also includes a pair of longitudinally extending rails 114 which are mounted along the upper longitudinal braces 99, 100, and which are aligned with the rails 90 of the front framework 72 when the front framework 72 is raised and the rear framework 94 is lowered as seen in FIG. 8.

In its transport position as seen in FIG. 3, the upper plant subassembly 26 is suitably secured to the front framework 72 by removable bolts (not shown), and when the front framework 72 is lifted to its raised position as seen in FIG. 8, the bolted interconnection may be released so as to permit the upper plant subassembly 26 to be rolled on the rollers 92 along the rails 90, 114, to the position immediately above the lower plant subassembly as seen in dashed lines. The two subassemblies 26 and 28 may then be bolted together. To facilitate the longitudinal movement of the upper plant subassembly 26 along the rails 90, 114, a connector 116, 117 may be mounted at each of its longitudinal ends. A first manually operable winch 118 (FIG. 8) is mounted to the rear housing portion 15*b*, and the winch 118 includes a cable 119 which may be entrained about a pulley 120 and then attached to the connector 116 at the rear of the upper plant subassembly 26. When so attached, the winch 118 may be employed to easily roll the upper plant subassembly 26 to its raised intermediate position overlying the lower plant subassembly.

A second manually operable winch 122 is mounted to the front housing portion 15*a*, and the second winch 122 includes a cable 123 which may be entrained about a pulley 124 and then attached to the connector 117 at the front of the upper plant subassembly 26. When so attached, the winch 122 may be employed to easily roll the upper plant subassembly from the raised intermediate position back to its lifted temporary position as seen in solid lines in FIG. 8.

The main frame 15 of the apparatus also mounts an adjustable jack 125 which is positioned so as to extend downwardly from the bottom braces 40 of the front housing, and so as to be adapted to engage the ground as seen in FIGS. 1 and 8. Further, an attachment member 126 is mounted at the front end of the main frame which is adapted to be releasably connected to a tractor in a conventional manner. To provide further support when the tractor is withdrawn, a ground engaging post 127 is releasably attached to the main frame at a location adjacent the attachment member 126.

The elevator 14 of the present invention comprises an elongate housing 128 which has a material inlet end and an opposite material outlet end. The housing 128 includes an inlet 130 adjacent the inlet end and a discharge chute 132 adjacent the outlet end, and the elevator 14 further includes a conventional bucket-type conveyor (not shown) within the housing which is adapted to convey the aggregate from the inlet 130 to the discharge chute 132 when it is disposed in a vertical position as seen in FIG. 1.

The rearward portion of the housing 128 of the elevator 14 mounts an external framework 134 which in turn removably mounts a wheel assembly 135. The upper end of the housing mounts an attachment member 137 which is adapted to be connected to a tractor, and such that the elevator may be transported along a roadway, note FIG. 5. An adjustable jack 138 is also mounted adjacent the upper end of the housing 128, so as to permit the elevator 14 to be disconnected from the tractor.

The elevator 14 is adapted to be mounted to the rear of the main frame 15 so as to permit movement between a horizontal position as seen in FIG. 5, and an upright position adjacent the tower assembly as seen in FIG. 1. In the upright position, the elevator 14 is adapted to convey aggregate material upwardly from the material inlet 130 to the material discharge chute 132 and into the inlet 31 of the aggregate screen section when the tower assembly is lifted to its raised operative position.

The means for pivotally and releasably mounting the elevator 14 to the main frame 15 is best seen in FIGS. 5–7, and in this regard, it will be understood that the wheel support carriage 16 is removed and replaced by a support and pivot assembly 140 for the elevator as seen in FIGS. 5–7. More particularly, the support and pivot assembly for the elevator comprises a pair of longitudinal braces 141, 142 having outer free ends supported by a vertical ground engaging post 144, and the other ends are releasably bolted to the rear end of the main frame. An inclined reinforcing brace 145, 146 is positioned to interconnect the free end portion of each brace 141, 142 with the main frame 15. The free end portions of the braces 141, 142 also mount a journal 147 which defines a horizontal pivot axis spaced rearwardly from the rear portion of the main frame 15. The lower end portion of the elevator 14 includes a framework 148 which includes a transverse axle 149 which is adapted to be received in the journal 147.

A pivoting assembly is utilized to pivot the elevator 14 about the pivot axis, and for selective movement from its horizontal position as seen in FIG. 5 to its raised position as seen in FIG. 1, and from the raised position back to the horizontal position. The pivoting assembly includes a hydraulic winch 152 mounted to the main frame, and a pair of pulleys 153, 154 attached to the framework 134 of the elevator and the main frame respectively. A cable 155 is attached to the winch 152 and entrained about the pulleys 153, 154 so as to move the pulleys toward each other when the winch winds up the cable, to thereby pivot the elevator upwardly. The pivoting assembly also includes a hydraulic cylinder 156 connected between the main frame and the elevator at a location immediately adjacent the inlet end thereof. The hydraulic cylinder 156 is particularly useful in controlling the movement of the elevator as it approaches its vertical position, and for providing the initial force to pivot the elevator from its vertical position toward its lowered position.

Method of Erection

The method of erecting the apparatus at a job site will now be described. In this regard, it will be understood that the tower assembly 12 initially will be configured as seen in FIG. 3 and the elevator 14 initially will be configured as seen in FIG. 5 but separated from the tower assembly. Thus, both components may be transported over the highway to the job site by associated tractors.

Upon reaching the job site, the wheels 23 of the tower assembly 12 will be lowered with respect to the main frame 15 by means of the air bags 24, so as to cause the main frame to be lifted, and steel plate foundations 158 are then positioned and leveled below the braces of the rear frame portion. The air bags 24 are then exhausted, causing the main frame to drop onto the foundations 158. The adjustable jack 125 is then lowered, and the support post 127 is attached to the main frame. The tractor may then be disconnected and withdrawn.

The wheel support carriage 16 is then disconnected from the main frame 15, and replaced by the support and pivot assembly 140 for the elevator 14. The elevator 14 is then brought to the position shown in FIG. 5, and the axle 149 is secured in its supporting journals 147. Also, the adjustable jack 138 of the elevator is lowered so as to permit the tractor to be disconnected, and the wheel assembly 135 of the elevator is removed. Next, the cable 155 of the winch 152 is entrained between the pulleys 153, 154, and the hydraulic cylinder 156 is attached between the main frame and the elevator housing 128.

The next step involves the pivoting of the elevator 14 from its horizontal transport position to its upright position. This pivoting movement is effected by actuating the winch 152 and the hydraulic cylinder 156, so that the elevator 14 smoothly moves to its upright position. During the final stages of this movement, the elevator is guided between the guide and support arms 68, 69, note FIG. 7. Locking pins 159 may be inserted between openings in the elevator and support arms to retain the vertical position of the elevator.

The assembly of the tower 12 is commenced by first lifting the front framework 72 and the upper plant subassembly 26 to the lifted temporary position as seen in solid lines in FIG. 8. As noted above, in this position, the two pairs of rails 90, 114 are aligned and so that upon release of the bolted connection between the upper plant subassembly and the front framework, the upper plant subassembly may be moved rearwardly, with the rollers moving along the rails. This rearward movement may be effected by attaching the cable 119 from the winch 118 to the rear connector 116, with the cable being entrained about the pulley 120, so that actuation of the winch 118 to wind up the cable causes the upper plant subassembly to roll rearwardly. Once the upper subassembly 26 is in its proper position above the lower plant subassembly 28 raised intermediate, the two subassemblies are bolted together to form the plant as shown at the left side portion of FIG. 8. The plant 10 is then lifted by actuation of the four hydraulic cylinders 112, to the operative position shown in FIG. 1, and the pins 97 are then positioned so as to lock the braces 96 in their upper position as seen in FIG. 1. Also, the discharge chute 132 is aligned with the inlet 31 of the aggregate screen section.

As final steps, a conventional aggregate drum dryer 160 may be positioned so as to discharge heated and dried stone aggregate or the like into the inlet 130 of the elevator 14. Also, a dust collection duct 162 may be connected between the screening section and a cyclone separator 163 in the manner well known in the art, so as to return the dust to the dryer.

In the drawings and specification, there has been set forth a preferred embodiment of the invention, and although specific terms are employed, they are used in a generic and description sense only and not for purposes of limitation.

That which is claimed is:

1. A self erecting apparatus adapted for the batch production of asphalt, and comprising an elongate main frame having front and rear portions, and including a support structure for supporting the main frame upon the ground surface, an asphalt production plant comprising an upper plant subassembly and a lower plant subassembly, with said upper and lower plant subassemblies collectively comprising, when positioned with said upper plant subassembly immediately above said lower plant subassembly, (a) an aggregate screen section, (b) a bin section positioned below said screen section and comprising a plurality of side by side bins, (c) a weigh hopper positioned below said screen section, and (d) a mixer positioned below said weigh hopper, means mounting said lower plant subassembly on said rear portion of said main frame and including plant lifting means for lifting said lower plant subassembly between a lowered transport position and a raised position, means mounting said upper plant subassembly for movement between a lowered transport position on said front portion of said main frame and a raised intermediate position immediately above said lower plant subassembly when said lower plant subassembly is in its lowered transport position, whereby the apparatus may be transported with said upper and lower plant subassemblies positioned in their respective lowered transport positions, and at the job site, the upper plant subassembly may be moved to its raised intermediate position to form said asphalt production plant with said upper and lower plant subassemblies disposed in a vertical arrangement, and said asphalt production plant may then be lifted to a raised operative position of said apparatus by said plant lifting means.

2. The apparatus as defined in claim 1 further comprising an elongate elevator including a material inlet adjacent one end and a material discharge chute adjacent the opposite end, and means mounted to said rear portion of said main frame for pivotally and releasably mounting said elevator for movement between a horizontal transport position and an upright operative position and wherein said elevator is adapted to convey aggregate material upwardly from said material inlet to said material discharge chute and into said aggregate screen section when said asphalt production plant is lifted to said raised operative position thereof.

3. The apparatus as defined in claim 2 wherein said support structure for supporting said main frame upon the ground surface includes means releasably mounting a roadway engaging wheel assembly adjacent one of the ends of said main frame, and an attachment member mounted at the opposite end of said main frame which is adapted to be connected to a tractor, and such that upon removal of said elevator and positioning of said upper and lower frame subassemblies in their respective lowered transport positions, the apparatus may be transported along a roadway.

4. The apparatus as defined in claim 3 wherein said means releasably mounting a roadway engaging wheel assembly comprises a wheel support frame releasably mounted to said main frame, and air bag suspension means interconnecting said wheel assembly to said wheel support frame so as to permit said wheel assembly to be raised and lowered with respect to said wheel support frame.

5. The apparatus as defined in claim 3 further comprising means releasably mounting a roadway engaging wheel assembly to said elevator adjacent one of the ends thereof, and an attachment member mounted at the opposite end of said elevator which is adapted to be connected to a tractor, and such that upon removal of said elevator from said main frame the elevator may be transported along a roadway.

6. The apparatus as defined in claim 2 wherein said means for pivotally and releasably mounting said elevator to said main frame comprises a support frame releasably mounted to said rear portion of said main frame and so as define a horizontal pivot axis spaced rearwardly from said rear portion of said main frame, and means pivotally mounting the material inlet end of said elevator to said support frame so as to pivot about said pivot axis, and pivoting means connected between said elevator and said main frame for selectively pivoting said elevator about said pivot axis from said horizontal position to said raised position, and from said raised position back to said horizontal position.

7. The apparatus as defined in claim 6 wherein said pivoting means includes a hydraulic cylinder connected between said main frame and said elevator at a location immediately adjacent said material inlet end thereof, and a winch having a cable which is connected between a medial portion of the length of said elevator and said main frame.

8. The apparatus as defined in claim 1 wherein said means mounting said upper plant subassembly for movement between the lowered transport position and the raised intermediate position thereof comprises means for selectively lifting said upper plant subassembly vertically from said lowered transport position to a lifted temporary position above said front portion of said main frame, and means for selectively moving said upper plant subassembly horizontally between said lifted temporary position and said raised intermediate position located above said lower plant subassembly.

9. The apparatus as defined in claim 1 wherein said aggregate screen section includes sizing screen means for segregating an aggregate material by average particle size so as to obtain a plurality of groups of different average particle size and delivering the groups to respective ones of said bins of said bin section.

10. The apparatus as defined in claim 9 wherein each of said bins of said bin section includes a discharge gate mounted at the bottom thereof for selectively delivering the aggregate from such bin into said weigh hopper.

11. The apparatus as defined in claim 10 wherein said weigh hopper includes a discharge gate to permit the contents thereof to be selectively delivered into said mixer, and wherein said mixer includes a further discharge gate to permit the contents thereof to be selectively delivered into an underlying truck or the like.

12. The apparatus as defined in claim 11 wherein said bin section comprises a top section and a bottom section, and wherein said upper plant subassembly comprises said screen section and said top section of said bin section, and said lower plant subassembly comprises said bottom section of said bin section, said weigh hopper, and said mixer.

13. A self erecting apparatus comprising (a) a frame including (1) an attachment member for releasably connecting said frame to a tractor, and (2) a ground support structure for supporting said frame on the ground; and (b) an asphalt production plant comprising (1) a lower plant subassembly mounted on said frame and movable on said frame from a lowered transport position to a raised position, said lower plant subassembly including at least a mixer and a hopper positioned above said mixer, and (2) an upper plant subassembly mounted on said frame and movable on said frame, when said lower plant subassembly is in said lowered transport position, from a lowered transport position generally beside said lower plant subassembly to an intermediate position directly above said lower plant subassembly, said upper plant subassembly including at least an aggregate screen section, wherein said asphalt production plant further comprises a bin section forming part of at least one of said lower plant subassembly and said upper plant subassembly and comprising a plurality of side by side bins.

14. The apparatus as defined in claim 13 wherein said bin section comprises top and bottom sections, said bottom section forming part of said lower plant subassembly and said top section forming part of said upper plant subassembly.

15. The apparatus as defined in claim 13 wherein said upper plant subassembly is movable on said frame from said lowered transport position to said intermediate position through a temporary position located above and beside said lower plant subassembly.

* * * * *